US006378159B1

(12) United States Patent
Garrison et al.

(10) Patent No.: US 6,378,159 B1
(45) Date of Patent: Apr. 30, 2002

(54) SQUEEGEE WITH LIQUID DRAIN

(75) Inventors: David L. Garrison, Indianapolis; Steven C. Hawhee, Westfield, both of IN (US)

(73) Assignee: Remco Products Corporation, Zionsville, IN (US)

( * ) Notice: Subject to any disclaimer, the term of this patent is extended or adjusted under 35 U.S.C. 154(b) by 0 days.

(21) Appl. No.: 09/472,400

(22) Filed: Dec. 27, 1999

(51) Int. Cl.[7] ..... A47L 13/11; A47L 1/06
(52) U.S. Cl. ..... 15/245; 15/118
(58) Field of Search ..... 15/118, 121, 220.1, 15/245

(56) References Cited

U.S. PATENT DOCUMENTS

| | | | | | |
|---|---|---|---|---|---|
| 130,925 | A | * | 8/1872 | Little | |
| 138,322 | A | * | 4/1873 | Emory, Jr. | |
| 956,566 | A | * | 5/1910 | Brown | |
| 1,042,828 | A | * | 10/1912 | Selwa | |
| 1,139,834 | A | * | 5/1915 | Baugh | 15/121 |
| 1,376,195 | A | * | 4/1921 | Fernandez | |
| 1,897,726 | A | * | 2/1933 | Hillyard | |
| 5,347,676 | A | * | 9/1994 | Saitoh | 15/245 |
| 5,539,949 | A | * | 7/1996 | Stanton | 15/121 |
| 6,092,255 | A | * | 7/2000 | Kim | 15/121 |

FOREIGN PATENT DOCUMENTS

| | | | | |
|---|---|---|---|---|
| EP | 0117712 | * | 9/1984 | 15/245 |
| IT | 450210 | * | 7/1949 | 15/245 |

* cited by examiner

*Primary Examiner*—Randall E. Chin
(74) *Attorney, Agent, or Firm*—Woodard, Emhardt, Naughton, Moriarty & McNett

(57) ABSTRACT

A squeegee for removing liquid from a surface. A handle is removably mounted to a main body having a front wall, back wall, top wall, and end walls joined together forming a liquid receiving cavity when inverted. A pair of flexible strips are mounted to the front wall and back wall. A handle is mounted to the main body at an acute angle and may be connected to a drainage hose or a connector for receiving the liquid drained through the handle.

11 Claims, 5 Drawing Sheets

SQUEEGEE WITH LIQUID DRAIN

BACKGROUND OF THE INVENTION

1. Field of the Invention:

The present invention relates generally to the field of squeegees used to wipe liquid or water from a surface.

2. Description of the Prior Art:

In certain rooms, particularly those having machines or produce therein, condensation collects on the room ceiling particularly as a result of the cleansing of the machines or produce with water. The condensation eventually drips onto the machines, produce or floor providing a safety hazard and/or food contamination. The practice is therefore to wipe the condensation off the ceiling with a squeegee with the result that the liquid drips down. A technique is used of wrapping a squeegee with a cloth or by attaching sponges to the squeegee by large alligator clips to absorb the removed liquid. The squeegee must then be brought down from the ceiling in order to wring out whatever is being used to absorb the condensation. In the process, the person using the squeegee becomes wet and the liquid still drips down onto the machine, produce or floor. We have therefore designed a squeegee having a drain structure to convey the liquid away from the squeegee to either a container or a separate drain.

SUMMARY OF THE INVENTION

The preferred embodiment of the invention is a squeegee to remove liquid from a ceiling and a floor. The squeegee has a main body with a front wall and a back wall extending across the main body and a flexible first strip mounted to the front wall and depending therefrom to scrape liquid off of a ceiling as the main body is pulled thereacross. A flexible second strip is mounted to the back wall and depends therefrom to scrape liquid from a floor as the main body is pushed thereacross. The squeegee further has a handle mounted to the main body to allow the main body to be pulled and pushed across respectively a ceiling and a floor. The handle extends from the main body at an acute angle to position the first strip in contact with the ceiling and the second strip apart therefrom when the handle is positioned at approximately a right angle relative to the ceiling and to position the second strip in contact with the floor and the first strip apart therefrom when the handle is positioned at an acute angle relative to the floor.

It is an object of the present invention to provide a new and improved squeegee.

A further object of the present invention is to provide a squeegee with means for draining liquid from the squeegee when the squeegee is used to remove liquid from a ceiling or vertical surface.

A further object of the present invention is to provide a squeegee for wiping liquid from ceilings, vertical surfaces and floors.

Related objects of the present invention will be apparent from the following description.

DESCRIPTION OF THE PREFERRED EMBODIMENTS

Figure 1:
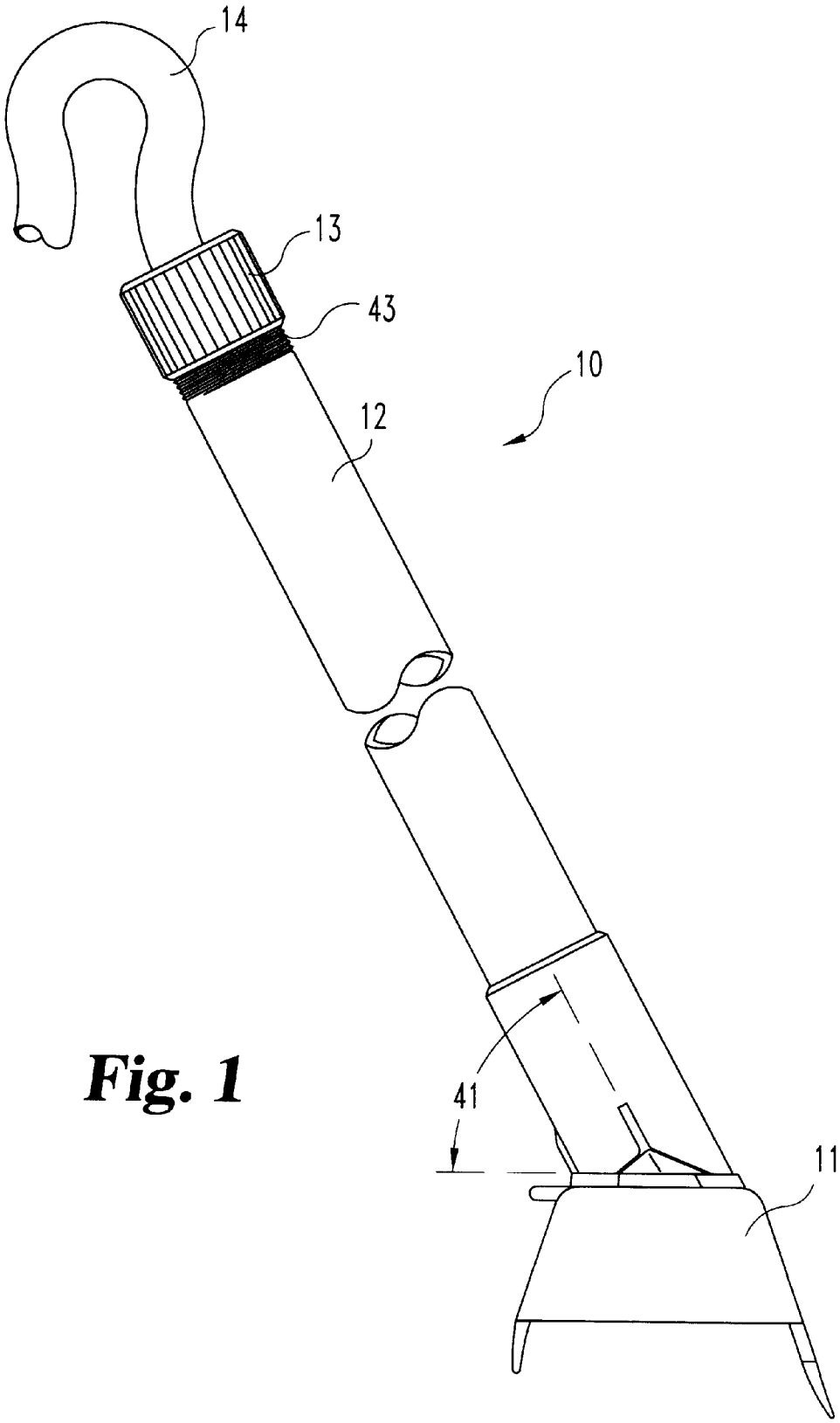
FIG. 1 is a fragmentary view of the preferred embodiment of a squeegee incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
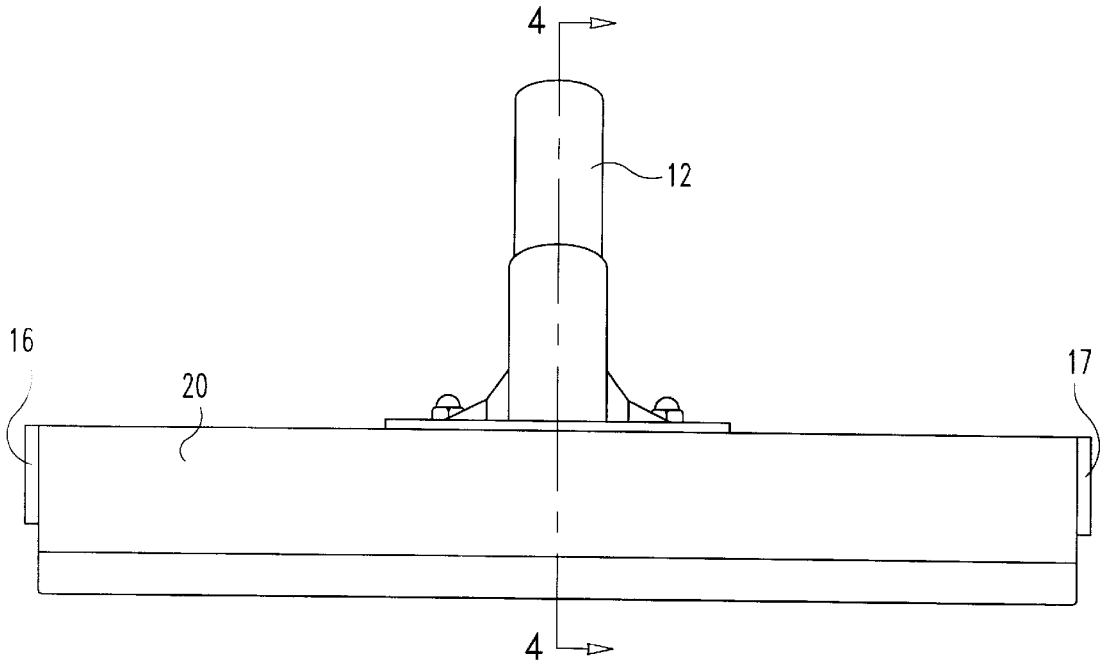
FIG. 2 is a right side view of the squeegee of FIG. 1.
Figure 3:
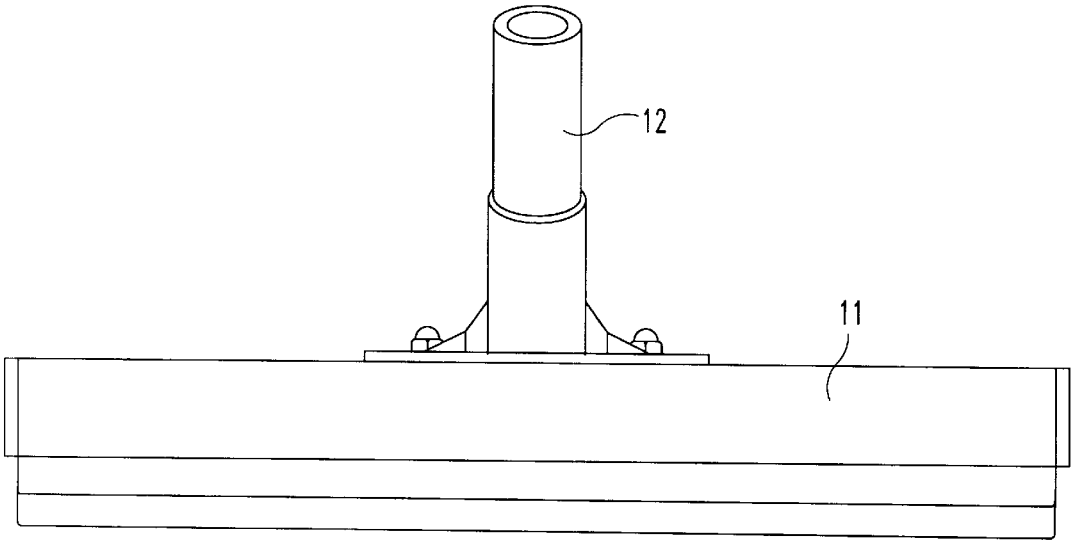
FIG. 3 is a left side view of the squeegee of FIG. 1.
Figure 4:
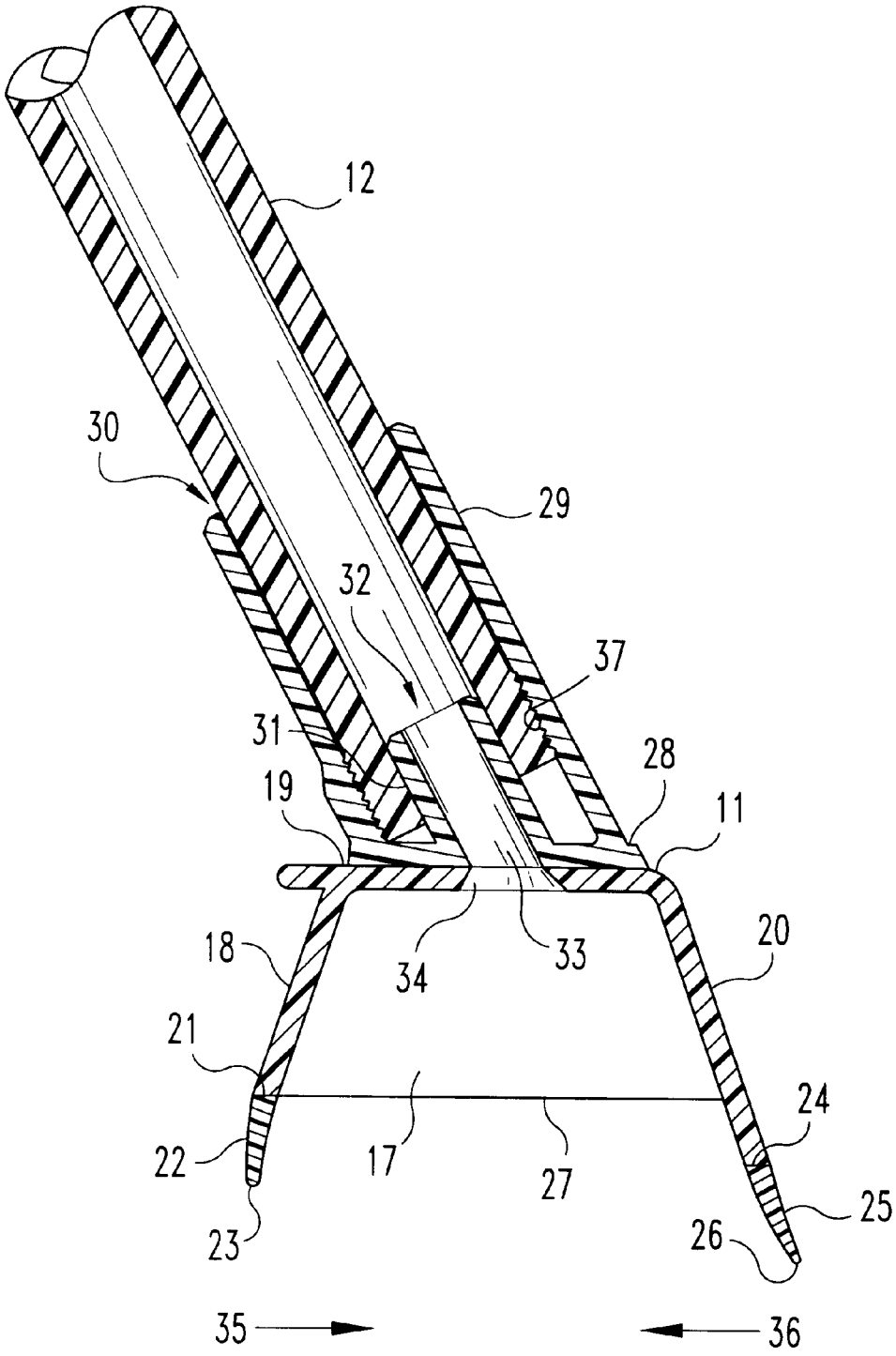
FIG. 4 is an enlarged cross-sectional view taken along the line 4—4 of FIG. 2 and viewed in the direction of the arrows.

Referring now more particularly to FIG. 1, there is shown a squeegee 10 including a main body 11 attached to a handle 12, in turn, connected to a flexible hose 14 attached to the handle by connector 13. Main body 11 includes a pair of end walls 16 and 17 (FIG. 2) connected to a front wall 20 and back wall 18 as well as a top wall 19 (FIG. 4). The front wall 20 and back wall 18 extend across the width of main body 11 between the opposite end walls 16 and 17.

A flexible strip 25 is fixedly attached to the lower distal end 24 of front wall 20 with a second flexible strip 22 fixedly attached to the bottom distal end 21 of back wall 18. Front wall 20 and strip 25 combine to have a length greater extending from top wall 19 as compared to the combined length of wall 18 and strip 22. As a result, distal end 26 of strip 25 is located lower in elevation as viewed in FIG. 4 as compared to distal end 23 of strip 22 relative to either top wall 19 or lower edge 27 of the end walls.

A handle-mounting bracket 28 is fixedly mounted to top wall 19 and includes an outer cylindrical tube 29 concentrically arranged relative to a cylindrical inner tube 31. Tube 31 extends upwardly from top wall 19 and is hollow forming a passage 33 aligned with a counter-sunk hole 34 having a smaller top inside diameter aligned with and equal to the inside diameter of passage 33. Likewise, handle 12 is hollow and is removably mounted between cylindrical tubes 29 and 31. The bottom end of handle 12 has external threads formed thereon in meshing engagement with internal threads 37 of tube 29. Thus, handle 12 can be inserted through the top end 30 of tube 29 and removably mounted to the squeegee main body by means of threads 37.

The top end of handle 12 has external threads 43 (FIG. 1) formed thereon in meshing engagement with a conventional cylindrical, internal threaded, connector 13, in turn, securing one end of a hose 14 to the handle. In an alternate embodiment, connector 13 may be unthreaded from handle 12 disconnecting hose 14 from the squeegee. A plastic container 39 (FIG. 5) may be mounted to handle 12 in lieu of the hose. Container 39 has a removable lid 42 threadedly mounted thereon with the lid having an internally threaded lid aperture in meshing engagement with threads 43 of handle 12. Hole 46 allows air to escape as the container is filled.

Handle 12 is arranged at an acute angle 41 (FIG. 1) relative to the top wall 19 of the main body. As a result, when the squeegee is inverted and the longitudinal axis of handle 12 is positioned at an approximate 90 degree angle with respect to ceiling 38 (FIG. 5), only strip 25 contacts ceiling 38 with strip 22 being spaced therefrom. The handle 12 may then be pulled in the direction of arrow 36 (FIG. 4) allowing the condensation on ceiling 38 to be wiped therefrom by strip 25 with the liquid falling into a liquid receiving cavity formed by the front wall 20 (FIG. 4), back wall 18, wall 19, and end walls 16 and 17. The condensation then flows via counter sunk hole 34 into passage 33 and out the opposite end 32 of inner tube 31 into the hollow handle 12 eventually flowing into container 39. Alternatively, the container can be removed allowing the condensation to flow from handle into hose 14 with the opposite end of the hose located adjacent a floor drain.

Figure 6:
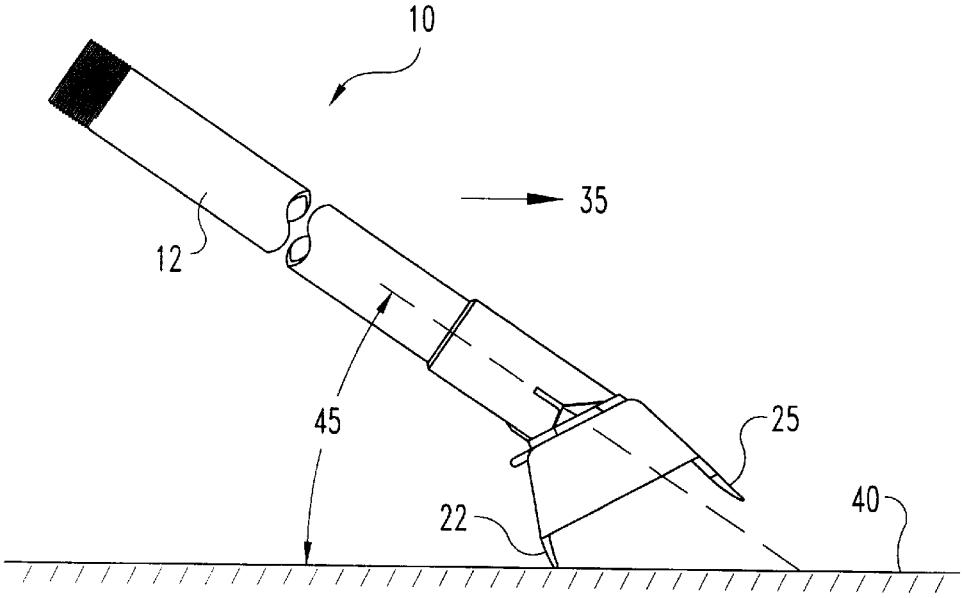
FIG. 6 is a view of the squeegee of FIG. 1 being used to wipe liquid on a floor.

In addition to wiping or scraping liquid from a ceiling, the squeegee may also be used to move liquid on any flat surface including the floor or a vertical surface. When using a squeegee to wipe liquid relative to floor 40, the handle 12 is gripped forming an acute angle 45 (FIG. 6) between the floor and handle thereby spacing apart strip 25 relative to the floor, whereas strip 22 is in contact with the floor. The handle is then pushed in the direction of arrow 35 forcing the liquid along the floor to a suitable drain. When using the squeegee to wipe liquid on floor 40, neither hose 14 or container 39 is connected to the top end of the handle.

Figure 5:
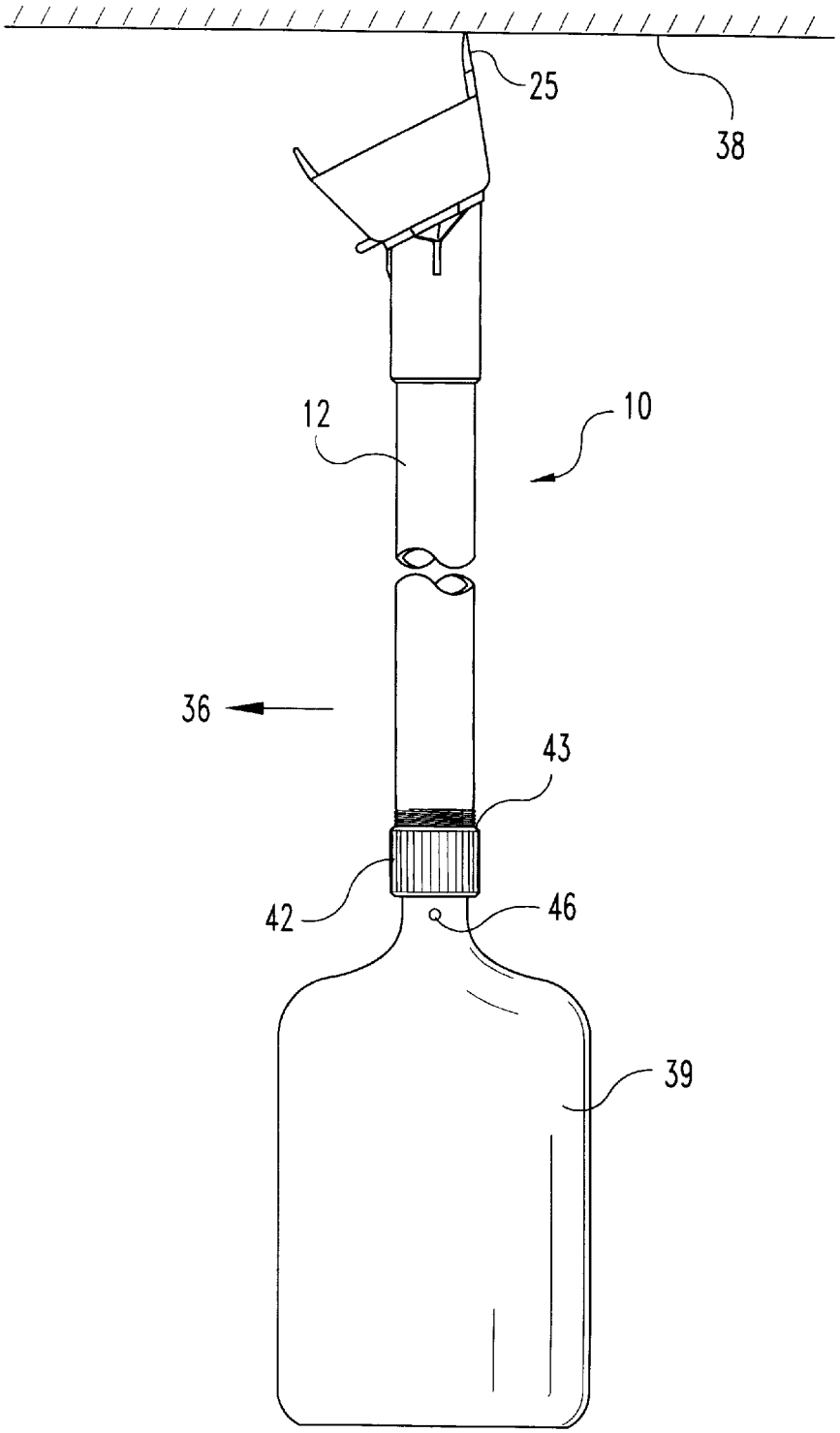
FIG. 5 is a view of an alternate embodiment of the squeegee used to remove liquid from a ceiling.

The pair of strips 22 and 25 along with the lower edge 27 of end walls 16 and 17 are spaced apart to form an upwardly opening liquid collection cavity when the main body in inverted such as depicted in FIG. 5. The cavity is sufficiently large to prevent the liquid from overflowing as the liquid is drained downwardly through the handle. Wall 18 forms an included angle with wall 19 of approximately 114 degrees and wall 20 forms an included angle with wall 19 of approximately 114 degrees. Handle 12 is arranged an acute angle 41 of approximately 45 degrees.

The handle is particularly stable relative to main body 11 since tube 29 surrounds the handle, in turn, extending around the inner cylindrical tube 31. Alternative means may be used to secure the handle to the mounting bracket, such as, producing the handle and mounting bracket 28 as an integral component. Different material may be used in producing squeegee 10. In one embodiment, the handle and main body of the squeegee are produced from plastic whereas strips 22 and 25 are either a flexible plastic or rubber material.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A squeegee to remove liquid from a ceiling and a floor comprising:

a main body with a front wall and a back wall extending across said main body;

a flexible first strip mounted to said front wall and depending therefrom to scrape liquid off of a ceiling as the main body is pulled thereacross;

a flexible second strip mounted to said back wall and depending therefrom to scrape liquid from a floor as the main body is pushed thereacross; and, a handle mounted to said main body and extending therefrom to allow said main body to be pulled and pushed across respectively a ceiling and a floor, said handle extending from said main body at an acute angle to position said first strip in contact with said ceiling and said second strip apart therefrom when said handle is positioned at approximately a right angle relative to said ceiling and to position said second strip in contact with said floor and said first strip apart therefrom when said handle is positioned at an acute angle relative to said floor; and wherein:

said front wall and said first strip combine to have length greater than said back wall combined with said second strip;

said main body is open between said first strip and said second strip to form an upwardly opening liquid collection cavity when said main body is inverted.

2. A squeegee to remove liquid from a ceiling and a floor comprising:

a main body with a front wall and a back wall extending across said main body;

a flexible first strip mounted to said front wall and depending therefrom to scrape liquid off of a ceiling as the main body is pulled thereacross;

a flexible second strip mounted to said back wall and depending therefrom to scrape liquid from a floor as the main body is pushed thereacross; and, a handle mounted to said main body and extending therefrom to allow said main body to be pulled and pushed across respectively a ceiling and a floor, said handle extending from said main body at an acute angle to position said first strip in contact with said ceiling and said second strip apart therefrom when said handle is positioned at approximately a right angle relative to said ceiling and to position said second strip in contact with said floor and said first strip apart therefrom when said handle is positioned at an acute angle relative to said floor; and wherein:

said main body includes a pair of end walls and a top wall joined to said front wall and said back wall to form a liquid collection cavity when inverted to contact a ceiling.

3. The squeegee of claim 2 and Anther comprising:

a mounting connector secured to said top wall having threads therein meshingly engaging and securing said handle thereto, said connector having an outer cylinder extending around said handle and an inner cylinder around which said handle surrounds with said handle being secured between said outer cylinder and said inner cylinder by said threads.

4. The squeegee of claim 2 wherein:

said top wail has a hole therethrough leading into said handle which is hollow allowing liquid within said cavity to escape through said handle.

5. The squeegee of claim 4 and further comprising:

a hose connected to said handle to direct liquid therefrom.

6. The squeegee of claim 4 and further comprising:

a container connected to said handle to collect liquid therefrom.

7. A device for removing water from a ceiling comprising:

a main body for collecting water scraped from a ceiling and having a drainage hole through which said water flows;

a flexible first strip mounted to said main body to scrape water from the ceiling when moved thereacross;

a handle mounted to said main body and extending therefrom to allow said main body and said strip to be moved across said ceiling, said handle is hollow to receive water draining from said main body through said hole;

said main body includes a front wall, a back wall, a pair of end walls, and a top wall joined together forming a water collection cavity when said main body is inverted and said handle is pulled scraping said strip against said ceiling to collect water in said cavity; and, a flexible second strip mounted to said back wall and depending from said main body a distance less than said first strip.

8. The device of claim 7 wherein said handle is arranged relative to said main body at an acute angle.

9. A squeegee to remove liquid from a ceiling and a floor comprising:

a main body with a front wall and a back wall extending across said main body; a flexible first strip mounted to said front wall and depending therefrom to scrape liquid off of a ceiling as the main body is moved thereacross; and, a flexible second strip mounted to said back wall and depending therefrom to scrape liquid relative to a floor as the main body is moved thereacross; and wherein:

said front wall and said first strip combine to have length greater than said back wall combined with said second strip;

said main body is open between said first strip and said second strip to form an upwardly opening liquid collection cavity when said main body is inverted.

10. The squeegee of claim 9 wherein:

said main body includes a pair of end walls and a top wall joined to said front wall and said back wall to form a liquid collection cavity when inverted to contact a ceiling.

11. The squeegee of claim 10 wherein:

said top wall has a hole therethrough allowing liquid within said cavity to escape through said handle.

* * * * *

UNITED STATES PATENT AND TRADEMARK OFFICE

CERTIFICATE OF CORRECTION

PATENT NO. : 6,378,159 B1 
DATED : April 30, 2002
INVENTOR(S) : David L. Garrison and Steven C. Hawhee It is certified that error appears in the above-identified patent and that said Letters Patent is hereby corrected as shown below:

Column 4,
Line 34, please change "Anther" to -- further --.
Line 43, please change "wail" to -- wall --.

Signed and Sealed this

Twenty-fifth Day of February, 2003

JAMES E. ROGAN
*Director of the United States Patent and Trademark Office*